US005749647A

United States Patent [19]

Migny

[11] Patent Number: 5,749,647

[45] Date of Patent: May 12, 1998

[54] MATRIX ARRAY DISPLAY PANEL

[75] Inventor: Philippe Migny, Saint Cyr-sur-Loire, France

[73] Assignee: Securite et Signalisation, Tours Cedex, France

[21] Appl. No.: 708,190

[22] Filed: Sep. 6, 1996

[30] Foreign Application Priority Data

Sep. 6, 1995 [FR] France ..... 95 10427

[51] Int. Cl.[6] ..... F21V 1/00

[52] U.S. Cl. ..... 362/248; 362/236; 362/292; 362/354; 40/579

[58] Field of Search ..... 40/550, 579, 580; 362/235, 236, 240, 248, 249, 290, 292, 354, 359, 360, 812

[56] References Cited

U.S. PATENT DOCUMENTS 4,032,222 6/1977 Lapeyre ..... 359/613

FOREIGN PATENT DOCUMENTS 0 016 272 A1 10/1980 European Pat. Off. .

*Primary Examiner*—Alan Cariaso

*Attorney, Agent, or Firm*—Brinks Hofer Gilson & Lione

[57] ABSTRACT

The invention relates to a display panel presenting a matrix array constituted by a plurality of light emitting elements. A mask composed of a vertical wall presents a plurality of openings opposite the light emitting elements and a plurality of fins directed towards the display surface and at a distance therefrom. The mask intercepts virtually all the sun's radiation and avoids heating of the display surface due to such radiation.

5 Claims, 2 Drawing Sheets

MATRIX ARRAY DISPLAY PANEL

FIELD OF THE INVENTION

The present invention relates to the field of displaying variable messages by means of light emitting elements disposed in matrix array on a display surface of a panel.

BACKGROUND OF THE INVENTION

This type of display panel is used in particular for displaying alphanumeric characters or graphic elements, outdoors, on highways and motorways for example.

The visual performance of these variable-message panels employing light emission is, outdoors, affected by the reflection from the sun on the display surface.

Whether the light emitting elements, which constitute the dots or pixels of the display surface, are ends of optical fibers, lamps or electroluminescent diodes, the performance of a light display panel is a function of the contrast. The contrast may be defined as the ratio of the luminance emitted by the illuminated panel over the luminance reflected by the extinguished panel, for a given lighting outdoors.

The minimum contrast values to be respected vary depending on the applications and the countries. By way of example, the variable message panels intended for road signs must offer a contrast at least equal to 10 for an outdoor illumination of 40000 lux, applied with an incidence of 10° above the horizon. In order to increase the contrast, it is always desirable that the luminance reflected by the extinguished panel be as weak as possible, whatever the technology adopted for the light emitting elements.

Now, in a display panel, it is the light emitting elements which are the most reflecting parts.

This is why the display panels are most often equipped with shields borne by the support of the light emitting elements in order to avoid the sun's rays striking the pixels directly, each shield being fixed to the support immediately above a light emitting element.

The length of these shields is in direct relation with the dimension of the pixel and the minimum incidence of the sun's rays of which the reflection by the light emitting elements is to be avoided. For a pixel with a diameter of 10 mm for example, the length of the shield is at least 57 mm, if it is desired to avoid all the reflections for the sun's rays having an incidence greater than or equal to 10° above the horizon.

However, this solution presents the drawback of a very poor evacuation of the calories, which, likewise, come from the sun's rays.

In fact, although the shields largely contribute to reducing the sun's reflections on the light emitting elements, due to their geometry and arrangement, they significantly increase the total surface illuminated by the sun, and, being black in colour, like the matter surrounding the pixels, they act as veritable solar collectors, considerably adding calories near the light emitting elements. For a display panel exposed to full sunlight, it is possible to attain and even exceed 100° C. on these black surfaces. Such a temperature is detrimental to the functioning of most known light emitting elements, such as electroluminescent diodes, for example. To ensure correct functioning of this type of component, a system for evacuating the calories by forced air circulation must be employed. However, the forced circulation of air, by the addition of fans, for example, is rendered inefficient due to the presence of the shields which prevents the flow of the air.

It is an object of the present invention to overcome these drawbacks, by dissociating the support of the light emitting elements and the means for intercepting the sun's rays and by providing a shaft between the display surface and said means, which considerably improves the efficiency of a forced circulation of air, if necessary.

SUMMARY OF THE INVENTION

The invention therefore relates to a display panel of the type comprising a plurality of light emitting elements arranged in matrix array on a vertical display surface and means for preventing the sun's rays from directly striking said light emitting elements beyond a given minimum incidence in a vertical plane, while allowing an observer to see the image constituted by said light emitting elements at an angle of observation smaller than a given maximum angle of observation.

This display panel is characterized in that said means are constituted by a mask disposed in front of the display surface and at a distance therefrom, said mask comprising a vertical wall parallel to the display surface, which presents a plurality of openings each disposed opposite a light emitting element, said openings being dimensioned and positioned with respect to the light emitting elements so that the light emitted thereby is visible by an observer who is looking at said panel at an angle of observation smaller than the given maximum angle of observation, and further comprising a plurality of fins directed towards the display surface and intended to intercept at least in part the sun's rays passing through said openings, in order that the light emitting elements not be struck by the sun's rays at an angle of incidence greater than the minimum angle of incidence.

Thanks to this arrangement, the vertical wall of the mask intercepts the greater part of the sun's radiation which strikes the panel, and the fins likewise intercept the major part of the sun's radiation which passes through the openings. Only a very small portion of sun's radiation strikes the display surface between the light emitting elements for medium or high incidences.

The free ends of the fins are distant from the display surface. This arrangement considerably improves the possible forced circulation of air which takes place in the shaft separating the display surface and the fins and in the shaft separating the mask and the transparent protecting wall forming the front face of the panel. In any case, calories accumulate in the mask and such accumulation does not disturb normal functioning of the light emitting elements.

The openings preferably present a square or rectangular section and the fins extend from the lower zones of the openings towards the display surface at an angle at least equal to the given maximum angle of observation.

The mask is advantageously made by cutting out and bending a metal sheet.

BRIEF DESCRIPTION OF THE DRAWINGS

The invention will be more readily understood on reading the following description with reference to the accompanying drawings, in which.

DESCRIPTION OF PREFERRED EMBODIMENT

Figure 1:
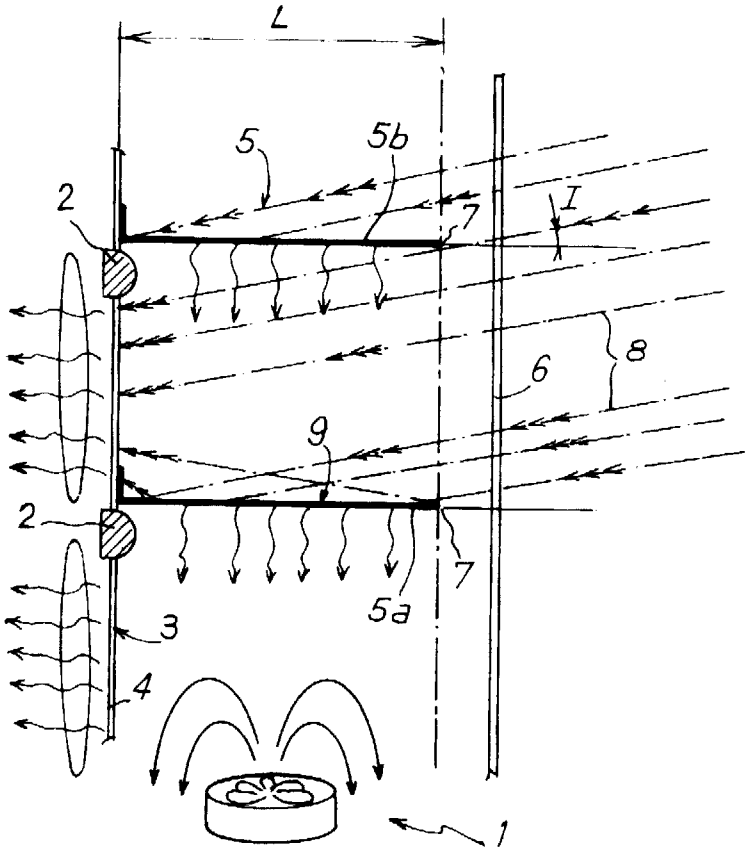
FIG. 1 is a section in elevation of a panel for displaying variable elements in matrix form, according to the state of the art.

Referring now to the drawings, FIG. 1 firstly shows a known panel for displaying variable messages, which comprises a plurality of light emitting elements 2 disposed in matrix form, i.e. in rows and columns, on a display surface 3 which may for example be the visible front face of a support 2 on which the light emitting elements 2 are mounted.

This display panel 1 is intended to be used outdoors, for example on a highway, in order to provide road users with variable informative messages constituted by alphanumeric characters or graphic elements.

It will be assumed in the following that the display surface 3 is disposed vertically, and perpendicularly to the direction of the traffic on the roadway. The variable Information to be displayed is obtained by emitting light from light emitting elements 2 selected by a control system of known type (not shown in the drawing).

In order to avoid the sun's rays being reflected on the light emitting elements 2 at an incidence greater than a minimum incidence I above the horizon, for example of 10°, a shield 5 is associated with each light emitting element 2. This shield 5 extends towards the front of the panel 1 and is fixed to the support 4 immediately above the corresponding element 2.

Reference 6 represents a transparent protecting plate forming the front face of the display panel 1 and located at a distance from the ends 7 of the shields 5.

The length L of the shields 5 is a function of the dimension of the light emitting elements 2. If the latter have a diameter of 10 mm, the length L is at least equal to 57 mm, in order that the light rays which have an incidence greater than 100° cannot strike the elements 2 directly.

As shown in FIG. 1, all the sun's rays 8 which penetrate in the space located between two superposed shields 5*a* and 5*b*, for example, strike the upper face 9 of the shield 5*a* and also, at mean incidences, less than 45° for example above the horizon, the front face of the support 4.

The zone located near each light emitting element 2 is thus subjected to considerable heating, the shields 5 fixed to the support 4 forming thermal bridges.

The purpose of the present invention is to arrange for these zones to be less affected by the sun, for similar display surface arrangements.

Figure 2:
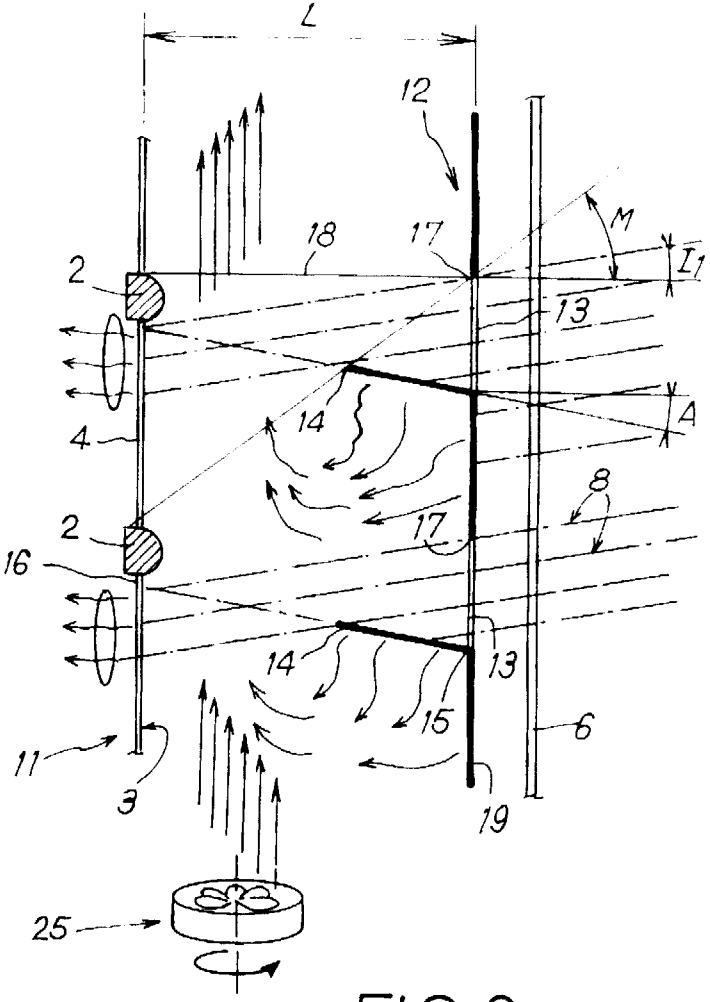
FIG. 2 is a section in elevation of a display panel according to a first embodiment of the invention.

FIG. 2 shows an embodiment of the invention. The display panel 11 according to the invention comprises a plurality of light emitting elements 2 disposed in matrix array on a vertical display surface 3 which may be the visible front face of a support 4 of said elements 2. On the front of the panel 11, there is also provided a transparent plate 6 forming the vertical front face of the display panel 11.

Between the display surface 3 and the transparent plate 6, there is provided a mask 12 constituted by a metal sheet comprising a plurality of openings 13 of rectangular or square shape, each opposite a light emitting element 2, and a plurality of fins 14, each directed from the lower edge 15 of an opening 13 towards the region 16 of the display surface 3 located immediately below the light emitting element 2 corresponding to said opening 13.

The upper edge 17 of each opening 13 is located in a horizontal plane 18 tangential to the upper edge of a light emitting element 2. The mask 12 is disposed at least at a distance L from the display surface 3, such that the sun's rays 8 having an incidence greater than the given minimum incidence I, for example 10°, and passing through a given opening 13, cannot strike the light emitting element 2 located opposite said opening 13 directly. This distance L is a function of the dimension of the elements 2, and is at least equal to 57 mm, if the elements 2 have, for example, a dimension of 10 mm.

The height and width of the openings 13 is calculated as a function of the maximum angles A of observation by an observer, in a vertical and horizontal plane. This maximum angle A is for example 10° below the horizon. With the preceding data, the height of an opening 13 is thus at least 20 mm, and the fins 14 are inclined with respect to the horizontal by an angle of 10°.

Supposing that the light emitting elements 2 are spaced apart from one another by 40 mm and that the width of the openings is also 20 mm, the vertical wall 19 of the mask 12 intercepts three-quarters of the sun's rays 8 which strike the mask 12.

Figure 3A:
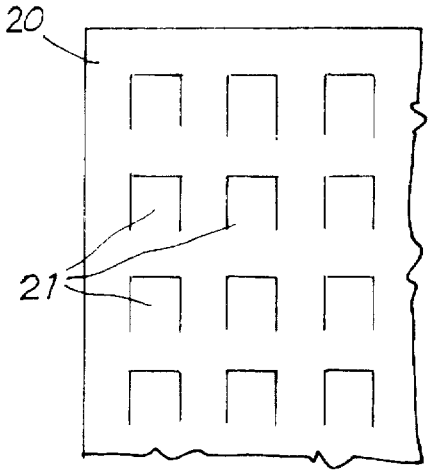
FIGS. 3A and 3B show an embodiment of the mask by cutting out and bending a metal sheet.
Figure 3B:
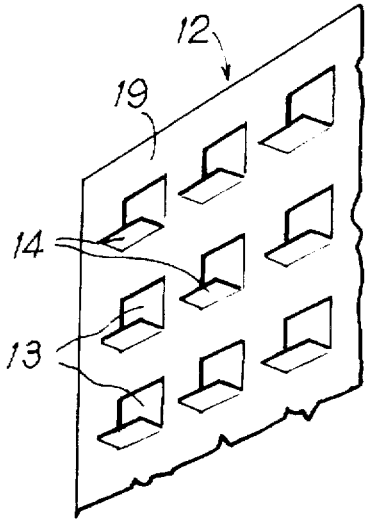

As shown in FIGS. 3A and 3B, the mask 12 is advantageously made from a flat metal sheet 20 in which U-shaped slots 21 are made to form the openings 13, and the zones defined by these slots are bent to form the fins 14.

As shown in FIG. 2, each fin 14 intercepts a large part of the sun's radiation passing through the immediately adjacent opening 13, in order to protect the light emitting element 2 located therebelow.

The fins 14 having a length of about 2 cm, it is observed that they intercept all the sun's rays 8 passing through the openings 13, when the incidence of these rays is greater than an intermediate angle of incidence M of about 45°.

Additional vertical fins 14*a*, 14*b* may also be disposed on each side of the openings 13 in order to intercept sun's rays whose incidence has a component in the horizontal plane 18. These additional fins may extend from a second metal sheet 21 cut out and bent like the sheet 20 constituting the mask 12 described hereinabove, but with I-shaped slots, these two sheets then being judiciously juxtaposed so that their openings are in register.

Figure 4:
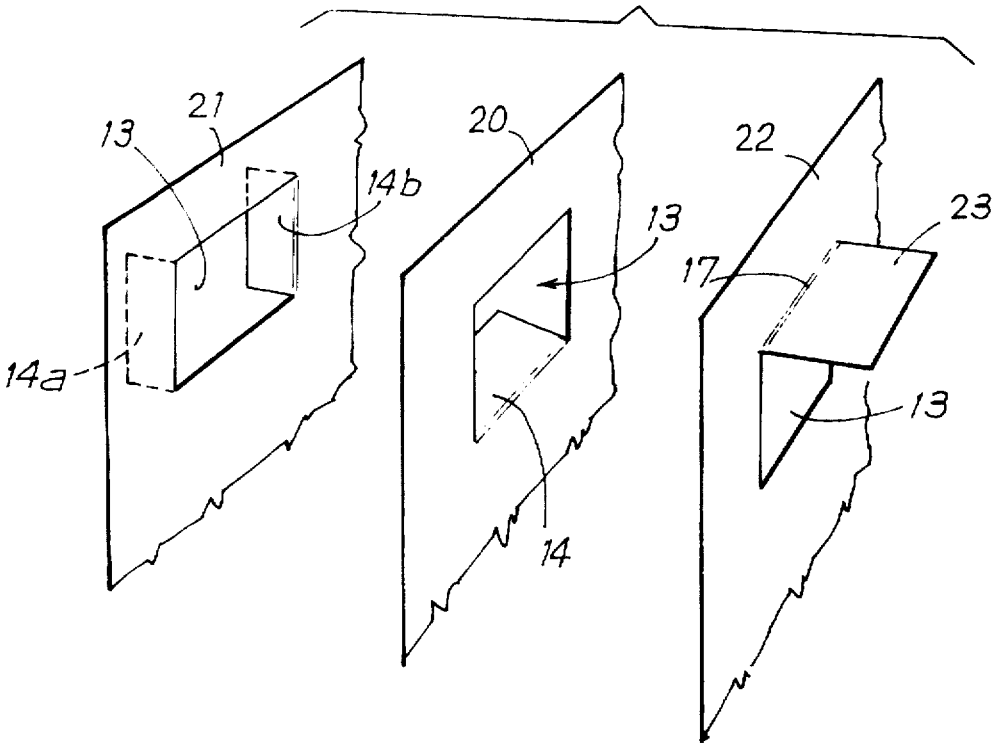
FIG. 4 shows an exploded view of an embodiment of the mask employing a plurality of juxtaposed sheets.

This assembly of two sheets 20, 21 may also be combined with a third sheet 22 comprising openings 13 and fins 23 directed towards the protecting plate 6 from the upper edge 17 of the openings 13, as shown in FIG. 4. This arrangement makes it possible, all things being equal, to reduce the values of the minimum incidence I and the intermediate incidence M.

Should the panel 11 present a forced circulation of air, in order to promote evacuation of the calories absorbed by the screen 12, a fan 25 is disposed in the lower part of the panel 11.

The support 4, the mask 12 and the transparent protecting plate 6 are obviously mounted in a frame (not shown in the drawings).

What is claimed is:

1. A display panel of the type comprising a plurality of light emitting elements arranged in matrix array on a vertical display surface and means for preventing the sun's rays from directly striking said light emitting elements beyond a given minimum incidence in a vertical plane, while allowing an observer to see an image constituted by said light emitting elements at an angle of observation smaller than a given maximum angle of observation, wherein said means are constituted by a mask disposed in front of the display surface and at a distance therefrom, said mask comprising a vertical wall parallel to the display surface, which represents a plurality of openings each disposed opposite a light emitting element, said openings being dimensioned and positioned with respect to the light emitting elements so that the light emitted thereby is visible by an observer who is looking at said panel at an angle of observation smaller than the given maximum angle of observation, and further comprising a plurality of fins directed towards the display surface and intended to intercept at least in part the sun's rays passing through said openings, in order that the light emitting elements not be struck by the sun's rays at an angle of incidence greater than the minimum angle of incidence.

2. The panel of claim 1, wherein the openings present a rectangular or square section and the fins extend from lower zones of the openings towards the display surface at an angle at least equal to the given maximum angle of observation.

3. The panel of claim 2, wherein the mask is made by cutting out and bending a first metal sheet.

4. The panel of claim 3, wherein the mask further comprises vertical fins disposed on either side of the openings and provided by a second metal sheet juxtaposed with respect to the first metal sheet.

5. The panel of claim 4, wherein the mask further comprises horizontal fins directed forwardly, disposed above the openings and fast with a third metal sheet.

* * * * *

UNITED STATES PATENT AND TRADEMARK OFFICE

CERTIFICATE OF CORRECTION

PATENT NO. : 5,749,647
DATED : May 12, 1998
INVENTOR(S) : Philippe Migny

It is certified that error appears in the above-identified patent and that said Letters Patent is hereby corrected as shown below:

Title page,
Item [56], column 2,
Before line 1, under "U.S. PATENT DOCUMENTS", please insert the following:

| | | | |
|---|---|---|---|
| -- 1,407,826 | 2/1922 | Webber | 40/580 --. |

After line 1, under "U.S. PATENT DOCUMENTS", please insert the following:

| | | | |
|---|---|---|---|
| -- 4,216,599 | 8/1980 | Eckert | 40/579 |
| 4,234,914 | 11/1980 | Boesen | 40/550 |
| 4,843,527 | 6/1989 | Britt | 362/236 |
| 5,321,417 | 6/1994 | Voelzke et al. | 40/550 |
| 5,390,092 | 2/1995 | Lin | 362/235 |
| 5,647,152 | 7/1997 | Miura | 362/354 --. |

Signed and Sealed this

Eleventh Day of December, 2001

*Attest:*

Nicholas P. Godici

NICHOLAS P. GODICI

*Attesting Officer*

*Acting Director of the United States Patent and Trademark Office*